US007048433B1

(12) United States Patent
Bhavnani et al.

(10) Patent No.: US 7,048,433 B1
(45) **Date of Patent: *May 23, 2006**

(54) SELF-RIGHTING, VARIABLE-ORIENTATION DISPLAY ASSEMBLY

(75) Inventors: Dilip K. Bhavnani, Commerce, CA (US); Yuet Leung So, Aberdeen (HK); Surjit Paul Singh Soni, Pasadena, CA (US); Carl Cetera, Tenafly, NJ (US)

(73) Assignee: Sun Coast Merchandise Corp., Commerce, CA (US)

( * ) Notice: Subject to any disclaimer, the term of this patent is extended or adjusted under 35 U.S.C. 154(b) by 350 days.

This patent is subject to a terminal disclaimer.

(21) Appl. No.: 10/241,422

(22) Filed: Sep. 10, 2002

(51) Int. Cl.
*G04B 37/00* (2006.01)
*G04B 19/00* (2006.01)

(52) U.S. Cl. ..... 368/316; 368/76; 368/225

(58) Field of Classification Search ..... 368/317, 368/316, 76, 225, 276; 248/114, 115, 116
See application file for complete search history.

(56) References Cited

U.S. PATENT DOCUMENTS

| | | | | |
|---|---|---|---|---|
| 2,425,602 | A * | 8/1947 | Drescher | 248/114 |
| D265,742 | S * | 8/1982 | Wilcox | D19/86 |
| 4,362,402 | A | 12/1982 | Kallinke et al. | 368/317 |
| 4,705,408 | A | 11/1987 | Jordi | 368/278 |
| D350,699 | S | 9/1994 | Lincourt | |
| D350,700 | S | 9/1994 | Lincourt | |
| 5,487,053 | A * | 1/1996 | Beiswenger et al. | 368/69 |
| 6,147,701 | A * | 11/2000 | Tamura et al. | 348/36 |
| 6,367,184 | B1 * | 4/2002 | Kheder | 40/617 |
| D466,822 | S * | 12/2002 | Li | D10/15 |
| 6,595,683 | B1 | 7/2003 | Cetera | |
| D492,359 | S * | 6/2004 | So | D19/90 |
| 6,751,164 | B1 * | 6/2004 | Sekiguchi | 368/80 |

OTHER PUBLICATIONS

"Bubble" clock web page printouts, 2 pages.*
U.S. Appl. No. 29/167,269, filed Sep. 10, 2002, Memo Holder With Display.
U.S. Appl. No. 10/241,421, filed Sep. 10, 2002, Self Righting, Variable Orientation Display Assembly.
Flexi-Clock With Clip/Stand, Model NOS FLXCLC/S, http://www.mayhemuk.com/products/flxclc.htm.
Swedaman Bubble Clock, http://www.swedausa.com/catalog/images/pg77.jpg.
60's Style TV Clock, stock code TVCKBK/SV http://www.mayhemuk.com/products/tvckbk.htm.
Platinum Twist Clock http://www.swedausa.com/catalog/images/pg73.jpg.

* cited by examiner

*Primary Examiner*—Andrew H. Hirshfeld
*Assistant Examiner*—Leo T. Hinze
(74) *Attorney, Agent, or Firm*—Brian M. Carpenter

(57) ABSTRACT

Disclosed is a display assembly comprising a graphical or alphanumeric display and display source such as a clock or other timepiece; a display housing for retaining the display; self-righting means rotatably coupled to the display and display housing with a predetermined bias; a body; and a connecting means operatively engaging the display housing and body. The connecting means in the form of a Cassegrain assembly allows the display housing to swivel with respect to the body over 360 degrees through a vertical plane and horizontal plane independently. The display, when operatively coupled to the self-righting means, is automatically maintained in a substantially upright position independent of the orientation display housing, thereby allowing the display to be turned to face a viewer at any angle without repositioning the body or leveling the display.

27 Claims, 4 Drawing Sheets

SELF-RIGHTING, VARIABLE-ORIENTATION DISPLAY ASSEMBLY

BACKGROUND

This invention relates to the field of variable orientation display structures. In particular, the invention relates to a self-righting display assembly with an articulated mounting structure that permits the direction of a display to be varied about at least two orthogonal axes, thereby allowing the display to be oriented at any angle with respect to the vertical or horizontal planes to which it attaches.

There are at least two prior art clocks that allow the orientation of the clock to be varied and can be attached to a mounting surface. These systems include the "clock with holder" disclosed in U.S. Pat. No. 4,362,402 to Kallinke et al. and the "flex-clock with clip/stand," model nos. FLCLC/S.

Kallinke discloses a clock fixed within a housing that is variably positioned between the arms of a V-shaped yoke. The inner surfaces of the yoke arms include a plurality of protrusions in the form of small detents and recesses that are adapted to engage corresponding recesses and detents, respectively, on the periphery of the clock housing. The clock housing is permitted to pivot with respect to the yoke about an axis created by two of a plurality of detents that engage the yoke on either side of the clock housing. The clock housing may rotate a total of approximately 90 degrees about the axis. One significant drawback of Kallinke's clock with holder is that the clock housing is restricted to rotate about one axis, generally described as the vertical axis or the horizontal axis, at any one time. Moreover, the angle of rotation of the housing about either axis is limited by the raised detents that physically obstruct and prevent the clock housing from rotating beyond the 90 degree angle.

The flex-clock with clip/stand, model FLCLC/S, includes a clock, fixed within a housing, attached to a clip or base by means of a flexible tubular structure. While the tubular structure permits the direction of the clock to be varied over a range of orientations relative to the clip or base, the flexible tubular structure fails to provide for pivotal movement between the clock housing and clip-type mounting structure. Nor does the clock have the ability to right itself which is important to maintain the clock face in position that is easily readable with minimal user intervention.

SUMMARY

Figure 1:
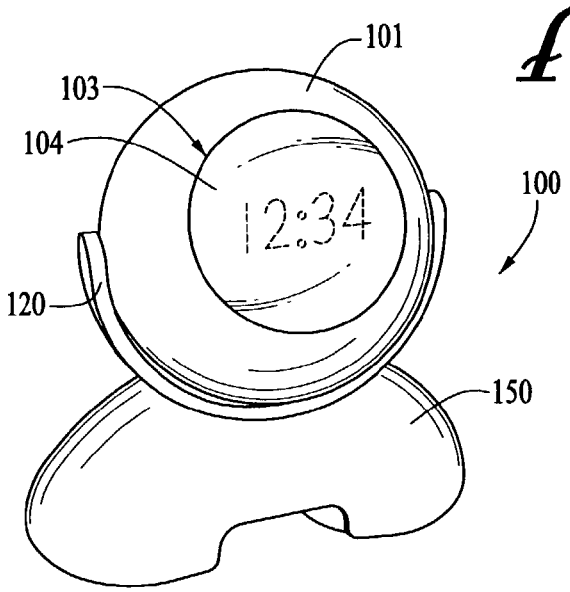
FIG. 1 is a perspective view of the self-righting, variable-orientation display assembly of the first preferred embodiment.

The present invention overcomes the limitations of the prior art with a display assembly comprised of a display that conveys graphical information generated by a display source; a display housing for receiving the display; self-righting means rotatably coupling the display and display housing; and a body operatively engaged to the display housing by a connecting means. The display source in some embodiments is an analog, or digital clock, calendaring device, temperature display, or other electromechanical display. In other embodiments, the display source generates advertising or promotional information, messages, or horoscopes, for example.

The self-righting means, when operatively coupled to the display, automatically maintains the display in a substantially upright position independent of the orientation display housing. The self-righting means in the preferred embodiment includes a bearing assembly and a biasing means for biasing the display into a substantially upright position. In the preferred embodiment, the bearing assembly includes a bearing and the biasing means includes a weight asymmetrically disposed with respect to the bearing's axis of rotation, although other structures including gyroscopes or position and motion actuators could be adapted to apply the torque necessary to bias the display.

The connecting means is comprised of at least one and preferably two pivotable connections that permit the display housing to swivel and or rotate with respect to the body, thereby allowing the display to be turned to face a viewer without repositioning the body. The connecting means, together with the self-righting means, enhances the readability or viewability of the display without the need to adjust the display housing so that the display is right-side-up. In the preferred embodiments, the connecting means is a cassegrain assembly that allows the display housing to swivel over 360 degrees through both a vertical plane and horizontal plane independently.

The body in some embodiments includes attaching means for permanently or removably affixing the display assembly to an object such as a smooth, planar surface. The attaching means in the first preferred embodiment is comprised of one or more suction cups, although clips, adhesive, and screws may be equally suitable.

In some embodiments, the display source includes a memory means capable of storing and recalling graphical or alphanumeric display indicia. The display source may further include a central processing unit for causing the indicia represented at the display to be varied over the course of time. The processing unit may, for example, cause the display to simultaneously or sequentially interleave images of the time in combination with advertising indicia. The assembly may further include an external communication means for operatively coupling to an external device from which display data is uploaded to the assembly's memory means.

DETAILED DESCRIPTION

The accompanying figures depict embodiments of the display assembly of the present invention, and features and components thereof. With regard to means for fastening, mounting, attaching or connecting the components of the present invention to form the apparatus as a whole, unless specifically described otherwise, such means are intended to encompass conventional fasteners such as machine screws, machine threads, snap rings, hose clamps such as screw clamps and the like, rivets, nuts and bolts, toggles, pins and the like. Components may also be connected by friction fitting, or by welding or deformation, if appropriate. Unless specifically otherwise disclosed or taught, materials for making components of the present invention are selected from appropriate materials such as metal, metallic alloys, natural or synthetic fibers, plastics, elastomers and the like, and appropriate manufacturing or production methods including casting, extruding, molding and machining may be used.

Any references to front and back, right and left, top and bottom, upper and lower, and horizontal and vertical are intended for convenience of description, not to limit the present invention or its components to any one positional or spatial orientation.

Referring to FIG. 1, a perspective view of the self-righting, variable-orientation display assembly of the first preferred embodiment is illustrated. The assembly 100 is comprised of a display housing 101 and a body 150 rotatably affixed to one another by a connecting means. The display housing 101 preferably includes a display window 103 through which the display 104 (see FIG. 4) may be viewed. The display 104 may take the form of any of a one of a number of digital or analog devices for displaying graphics, alphanumeric data, information, or advertising indicia.

The display housing 101 is connected to the body 150 with connecting means permitting the direction of the display 104 to be independently adjusted about at least one axis, preferably two. The connecting means adjustably supports and maintains the orientation of the display housing 101 relative to the body 150 until an operator applies the force necessary to re-direct the display housing 101 relative to the body 150.

Figure 2:
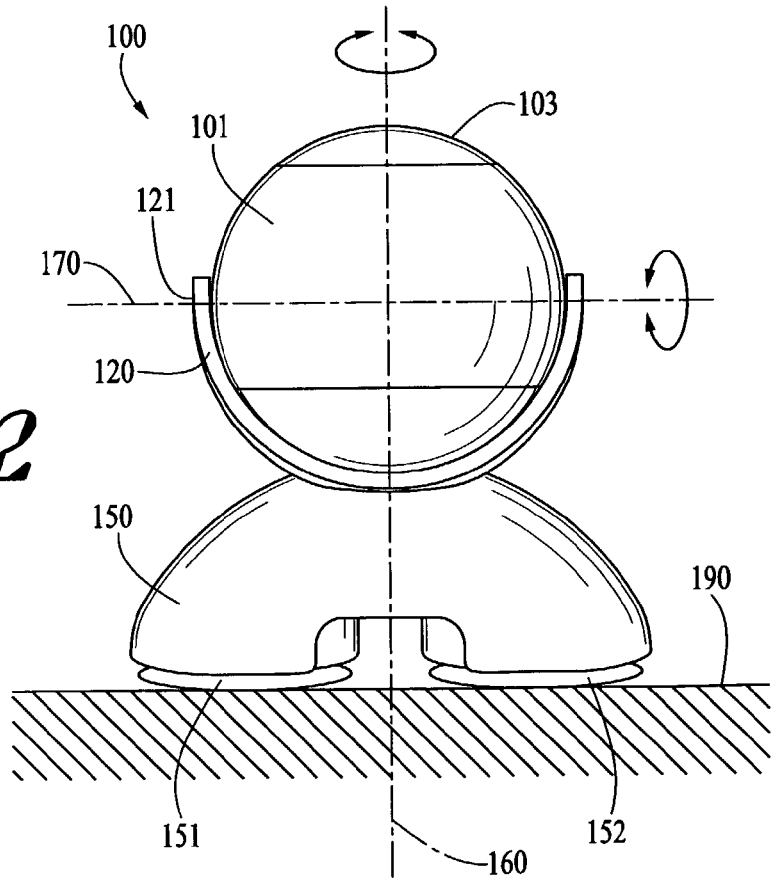
FIG. 2 is a frontal view of the self-righting, variable-orientation display assembly of the first preferred embodiment.

Referring to FIG. 2, a frontal view of the self-righting, variable-orientation display assembly of the first preferred embodiment is illustrated. In the first preferred embodiment, the connecting means permits the orientation of the display housing 101 to be re-directed about at two independent degrees of freedom. The connecting means comprises a gantry 120 that is rotatably affixed to the housing 101 by a first swiveling means and to the body 150 by a second swiveling means, thereby permitting the orientation of the display housing 101 to be redirected about two independent degrees of freedom. The first swiveling means permits the housing 101 to rotate relative to the gantry 120 about a first axis 170 up to a full 360 degrees in what is illustrated as a vertical plane, and includes a pair of pins 121 (See FIG. 3) that are affixed to the gantry 120 and rotatably engaged with the housing 101. The second swiveling means permits the gantry 120 to rotate relative to the body 150 up to a full 360 degrees in what is illustrated as a horizontal plane about a second axis 160, and includes a post (see FIG. 4). Together, the first and second swiveling means allow the display 104 to be directed at any angle to the top, bottom, or sides of the assembly 100.

In some embodiments, the body 150 is adapted to directly mate to the surface upon which it rests. In some embodiments, the assembly 100 includes attaching means for securing the display assembly 100 to an external object or surface. In the first preferred embodiment, the attaching means is comprised of one or more suction cups 152, 152 used to removably secure the display assembly 100 to a substantially planar surface 190.

Figure 3:
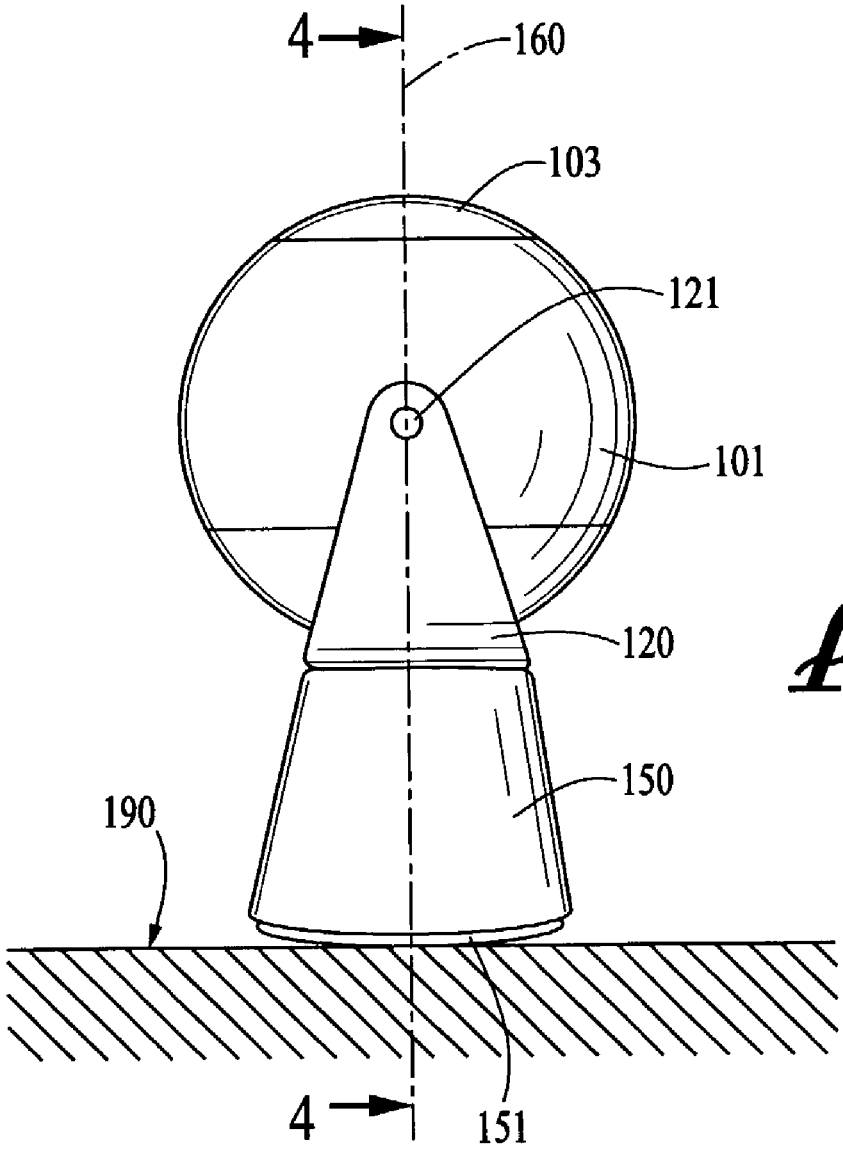
FIG. 3 is a side view of the self-righting, variable-orientation display assembly of the first preferred embodiment.

Referring to FIG. 3, a side view of the self-righting, variable-orientation display assembly of the preferred embodiment is illustrated. The first swiveling means including pin 121 is shown to pivotably attach the housing 101 to the gantry 120, thereby permitting the display housing 101 to rotate about what is characteristically described as the angle of declination for a display assembly 100 oriented in the vertical direction. The azimuth angle of the display housing 101 may also be adjusted by rotating the gantry 120 relative to the body 150 about the second axis 160.

Figure 4:
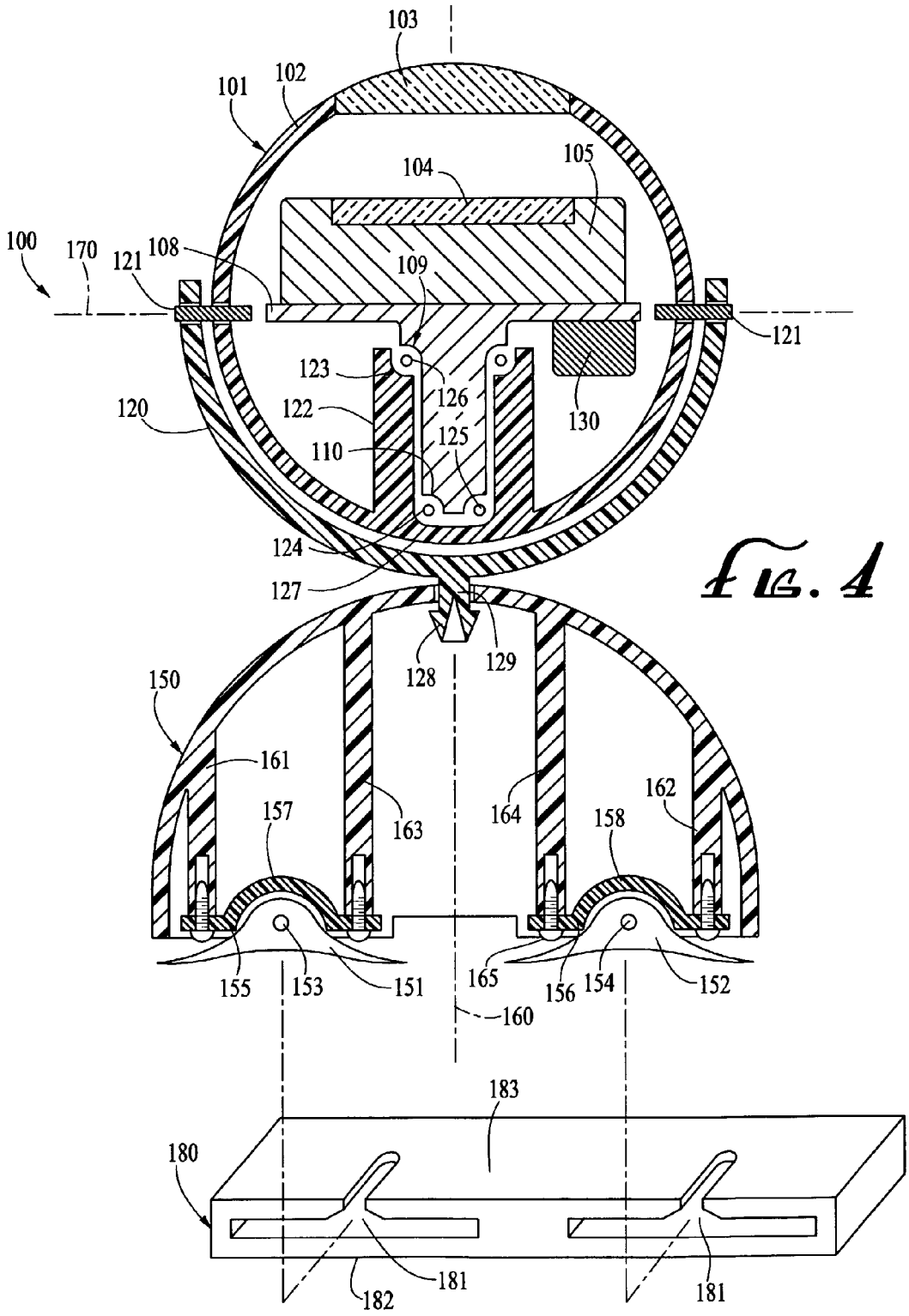
FIG. 4 is a diagrammatic cross section of the self-righting, variable-orientation display assembly of the first preferred embodiment.

Referring to FIG. 4, a diagrammatic cross section of the self-righting, variable-orientation display assembly of the preferred embodiment is illustrated. The display housing 101 in this embodiment protectively conceals the display 104, which is internally mounted within the display housing 101 with a self-righting means described below. In some embodiments, the display may attach directly to or operatively couple with the connecting means. In other embodiments, the display may be co-extensive with or external to some structure directly connected to the gantry.

The display 104 in the preferred embodiment is an analog or digital display capable of conveying text, numerical, or graphical information. The display 104 may be implemented in combination with back-lighting or projection-lighting. The display in the preferred embodiment is an LCD display, although one skilled in the art will recognize the suitability of an LED or incandescent display.

The information represented on the display 104 is generated by the display electronics 105 operative couple to the display 104. In the preferred embodiment, the display source 105 includes solid-state electronics or mechanical means for generating the time. Preferably, the time is entered, set, programmed, or otherwise modified using an input means that may be accessible on the display housing 101, display source 105, or other position on the exterior of the display assembly 100.

In other embodiments, the display source 105 includes a central processing unit that generates or otherwise modifies the image depicted at the display 104 in a predetermined manner. The processing unit may, for example, cause the indicia represented at display 104 to be varied in time whereby a plurality of images elements are simultaneously or sequentially interleaved over the course of time. In some embodiments, the display 104 depicts the time which is periodically interrupted with an advertising slogan or message, for example.

In some embodiments, the display source further includes a memory means from which the central processing unit retrieves data stored therein, the data including the graphical or alphanumeric indicia to be presented at display 104. The memory means in the preferred embodiment is a ROM (read-only memory) that is programmed during the manufacturing process. In other embodiments, the memory means may include a PROM (programmable ROM) or EPROM (erasable PROM) that allow the memory to be one or more times after manufacture. PROM and EPROM are preferable in embodiments of the assembly that include an external communication means for operatively coupling to an external device through which data is uploaded to the memory means. A USB port, radio frequency, or infrared communication link are examples of suitable external communication means, although one skilled in the art will recognize the suitability of alternative implementations.

The display 104 is visible through the substantially transparent lens 103, which in some embodiments is a convergent lens capable magnifying the graphic information in the display 104 to increase its visibility and readability. The external surface of the display housing 101 is preferably substantially spherical in shape to facilitate handling by the user and minimize any external protrusions that might otherwise inhibit the 360 degree rotation of the housing 101 about the first axis 170. The spherical shape of the external surface of the convergent lens 103 preferably compliments and smoothly transitions into the external surface of the shell 102 of the display housing 101.

The self-righting means maintains the top of the display 104 in a substantially upright position relative to the bottom of the display 104 to enable a viewer to see and read the graphics represented on the display 104. In the first preferred embodiment, the self-righting means comprises a bearing assembly and weight 130 mounted off-center from the axis or rotation of the bearing assembly. In first preferred embodiment, the bottom of the display 104 is the side associated with the weight 130. Alternative self-righting means may be comprised of a gyroscope, motion-sensitive circuit, or electromagnetic controls to regulate the position and or direction of the display 104.

The bearing assembly in this embodiment is comprised of a mounting structure 108 that is rigidly affixed to the display 104 and a bearing casing 122 that is rigidly affixed to the housing 101. The mounting structure 108 and bearing casing 122 are adapted to engage one another by means of first set of ball bearings 126 held captive in the ball bearing races 109,123 and the second set of ball bearings 125 contained within the ball bearing races 110,124. The mounting structure 108 is permitted to rotate freely with substantially no resistance, thus permitting the weight 130 that is operatively coupled to the display 104 to exert a torque that causes the display to settle under the force of gravity into a substantially upright position virtually independent of the orientation of the display assembly 100. While the display 104 may be forced to assume and inclined position, the weight 130 will always urge the display 104 into a preferred orientation with respect to the vertical, unless of course the display is in a direction co-parallel with the force of gravity. One skilled in the art will recognize that assembly 100 is designed to prohibit the mounting structure 108 from sliding out or otherwise disengaging the bearing casing 122 during normal operation of the display assembly 100.

As illustrated, the display housing 101 is operatively coupled to the gantry 120 in this embodiment with co-axial pins 121 that permit the rotation of the housing 101 about the first axis 170. The pins 121 may be individual components or formed as an integral part of either the gantry 120 or the display housing 101. The second swiveling means is comprised of a post 129 integrally incorporated in this preferred embodiment to the gantry 120 and rotatably engaged to the body 150 in a manner that permits these elements to swivel relative to one another about the second axis 160. The post 129 preferably includes a locking head 128 that flexibly compresses during insertion of the post 129 into the body and then expands to inhibit the gantry 120 from separating from the body 150 under normal operating conditions. The first and second swivel means may alternatively be comprised of various hinges, a ball joint, or trunnion, for example. One skilled in the art will recognize that with two independent axes rotation, the housing 101 may be adjusted to face any angle about the horizontal or vertical planes.

In some embodiment, the attaching means permanently or removably affixes the assembly 100 to another object. As illustrated in the preferred embodiment, the attaching means is comprised of a pair of suction cups 151,152 that are secured to the body 150 by rods 153,154 and base plates 157,158 that are affixed to the housing 150 by means of screws 165 that threadedly engage the base receptors 161, 162, 163, 164.

The attaching means may further include an anchor pad 180 with cavities 181 that are adapted to slidably receive the suction cups 151,152 such that the anchor pad 180 engages the body 150. The pad 180 may then be secured to a surface or object by adhesive, screws goods sold under the trademark VELCRO, or the like. One skilled in the art will recognize the suitability of numerous alternative attaching means comprising, for example, one or more clips, springs, adhesives including adhesive pads, bolts, for example, used to directly or indirectly affix the body 150 to another object.

Figure 5:
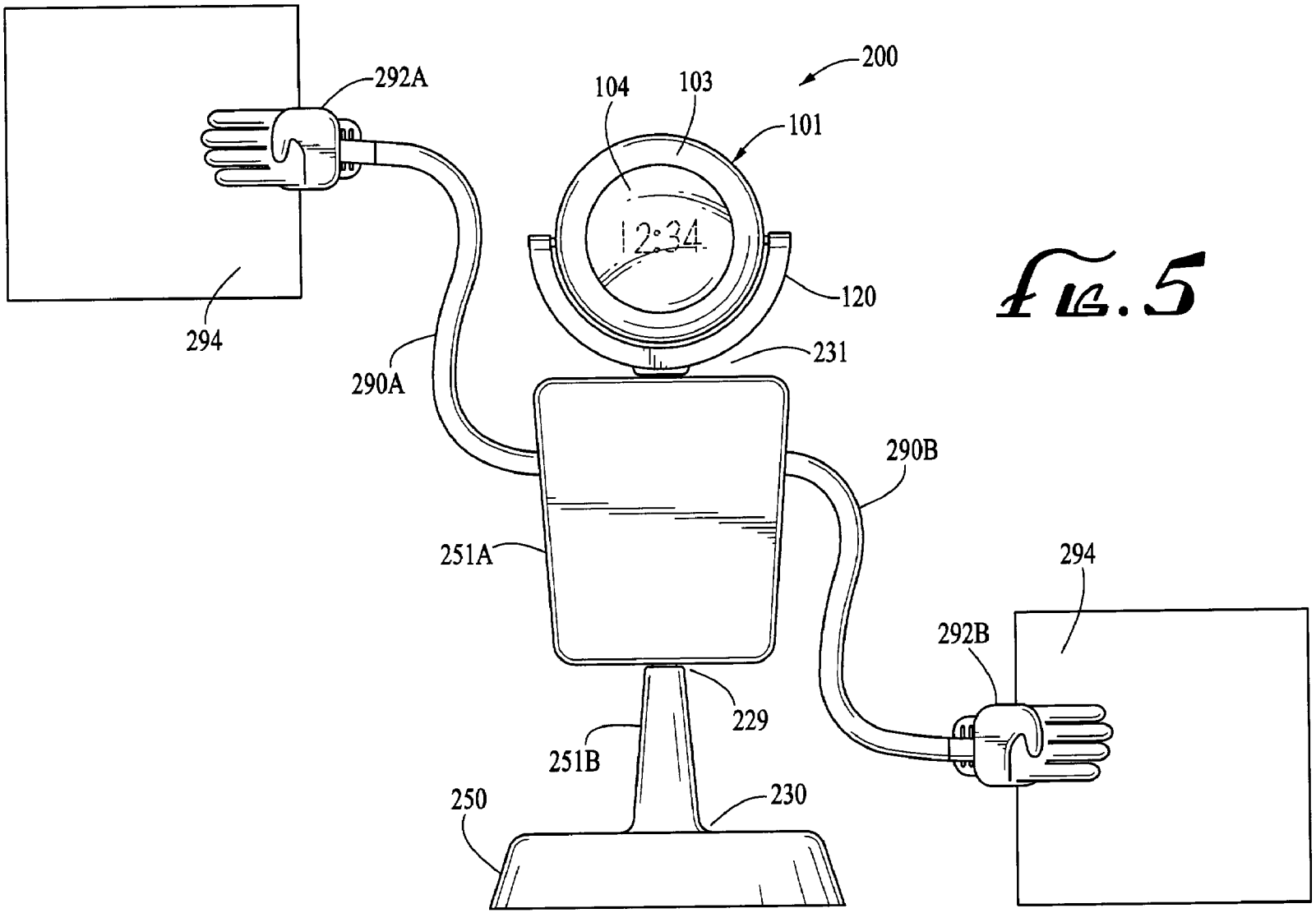
FIG. 5 is a frontal view of the self-righting, variable-orientation display assembly of the second preferred embodiment.

Illustrated in FIG. 5 is a frontal view of the self-righting, variable-orientation display assembly of the second preferred embodiment. The second preferred embodiment 200 includes a display housing 101 complete with display 104 and self-righting means, rotatable gantry 120, and body. The body is comprised of base section 250 and at least one middle section, illustrated in the preferred embodiment as middle sections 251A and 251B. The middle sections 251A and 251B are separate structures in some embodiments, but may be integrally connected to one another or to the adjacent gantry 120 or to the base section 250. In still other embodiments, the middle sections 251A and 251B are rotatably affixed to one another at pivot 229, to the gantry 120 at pivot 231, or to the body section 250 at pivot 230 using a connecting means comprised of a pin, pivot, hinge, or other structure permitting relative motion. The motion may include axial rotation, or tilting forward or to the sides.

The second preferred embodiment 200 further includes one or more grasping means including, for example, flexible members 290A and 290B with clasps 292A and 292B, respectively, for releasably securing various stationary or office-related products such as notes sheets 294. A flexible member 290A or 290B is preferably comprised of an elastic substance, including elastomer products or pliant wire or metallic links, that permit the clasps 292A and 292B to be repositioned at the convenience of the use. A clasp 292A or 292B preferably includes a clip, hook, binder, or fastener capable of holding or otherwise retaining the stationary or other article until the user disengages the product from the grasping device.

Although the above description contains many specifics, these should not be construed as limiting the scope of the invention, but rather as merely providing illustrations of some of the presently preferred embodiments of this invention.

Therefore, the invention has been disclosed by way of example and not limitation, and reference should be made to the following claims to determine the scope of the present invention.

We claim:

1. A display assembly comprised of:

a. a source for generating graphical information;

b. a display for conveying the graphical information to a viewer;

c. a display housing for retaining the display, d. self-righting means, operatively coupled to the display and display housing, including a bearing assembly and a multi axis biasing means; the bearing assembly providing relative rotational motion of the display with respect to the display housing; the biasing means urging the display into a substantially upright orientation independent of the orientation of the display housing; and e. a body operatively engaged with the display housing.

2. The display assembly of claim 1, wherein the bearing assembly includes a bearing characterized by an axis of rotation and the biasing means included a weight asymmetrically disposed with respect to said bearing assembly axis of rotation.

3. The display assembly of claim 2, wherein the assembly further includes a connecting means for rotatably coupling the display housing and the body.

4. The display assembly of claim 3, wherein the connecting means in comprised of at least one pivotable connection whereby the display housing may pivot up to 360 degrees with respect to a predetermined axis.

5. The display assembly of claim 3, wherein the connecting means is comprised of two substantially orthogonal, pivotable connections permitting the display housing to independently swivel through two substantially perpendicular planes.

6. The display assembly of claim 5, wherein the display includes a clock for displaying the time, elapse time, messages, calendaring information, temperature, advertising or promotional information, or horoscopes.

7. The display assembly of claim 5, wherein the display housing further includes a lens for magnifying the graphical information of the display.

8. The display assembly of claim 7, wherein the external surface of the display housing and lens form a substantially spherical shape.

9. The display assembly of claim 4, wherein the assembly further includes an attaching means for attaching the body to an object.

10. The display assembly of claim 9, wherein the attaching means further comprises one or more suction cups.

11. The display assembly of claim 9, wherein the attaching means further includes one of the group consisting of: clips, adhesive, and screws.

12. The display assembly of claim 1, wherein the assembly further includes on e or more input devices for setting and altering the graphical information of the display.

13. The display assembly of claim 1, wherein the source further includes:

a. a central processing unit for modifying the graphical information presented by the display; and b. memory means for storing data from which the graphical information is generated.

14. The display assembly of claim 13, wherein the assembly further includes an external communication means operatively coupled to the memory mens for transmitting data to the assembly form an external device.

15. A display assembly comprised of:

a. a source of generating graphical information;

b. a display for conveying the graphical information to a viewer;

c. a display housing for retaining the display;

d. self-righting means, operatively coupled to the display and display housing, including a bearing assembly and a multi axis biasing means; the bearing assembly providing relative rotational motion of the display with respect to the display housing; the biasing means urging the display into a substantially upright orientation independent of the orientation of the display housing;

e. a body; and f. connecting means, operatively coupling the display housing and body, including at least one pivotable connection for supporting rotational motion of the display housing with respect to at least one a predetermined axis.

16. The display assembly of claim 15, wherein the bearing assembly includes a bearing characterized by an axis of rotation and the biasing means includes a weight asymmetrically disposed with respect to said axis.

17. The display assembly of claim 15, wherein the connecting means is comprised of two pivotable connection permitting the display housing to independently swiveled about two predetermined axies.

18. The display assembly of claim 15, wherein display housing further includes a lens for magnifying the graphical information of the display; the external surface of the display housing and lens form a smooth, continuous surface.

19. The display assembly of claim 18, wherein the smooth, continuous surface formed by the display housing and lens is substantially spherical in shape.

20. The display assembly of claim 15, wherein the assembly further includes at least one flexible member anchored at the body, the flexible member including a grasping device for releasably securing articles to the assembly.

21. The display assembly of claim 15, wherein the display includes a liquid crystal display.

22. The display assembly of claim 15, wherein the source includes one or more light emitting diodes.

23. The display assembly of claim 22, wherein the source includes clock; and the graphical information conveyed to a viewer includes the display of the time.

24. A display assembly comprised of:

a. a source consisting essentially of a clock;

b. a display for displaying the time;

c. a display housing;

d. self-righting means, operatively coupled to the display and display housing, comprised of:

i. an assembly including at least one bearing, characterized by an axis of rotation, for supporting relative rotational motion of the display; and ii. multi axis biasing means for urging the display into a substantially upright orientation independent of the orientation of the display housing;

e. a body; and f. connecting means, operatively coupling the display housing and body, the connecting means including;

i. a first pivotable connections, characterized by a first axis of rotation, for supporting rotational motion of the display housing; and ii. a second pivotable connection, characterized by a second axis of rotation substantially perpendicular to the first axis of the rotation.

25. The display assembly of claim 24, wherein the display consist essentially of a liquid crystal display.

26. The display assembly of claim 24, wherein the display consist essentially of one or more light emitting diodes.

27. A display assembly comprising:

a. a source consisting essentially of a clock;

a. a display consisting essentially of a liquid crystal display for displaying the time;

b. a display housing;

c. self-righting means, operatively coupled to the display and display housing, comprising:

i. an assembly including at least one bearing, characterized by an axis of rotation, for supporting relative rotational motion of the display; and ii. a multi axis biasing means for urging the display into a substantially upright orientation independent of the orientation of the display housing;

d. a body comprising a middle section a base section;

e. connecting means, operatively coupling the display housing and body, including:

i. a first pivotable connection, characterized by a first axis of rotation, for supporting rotational motion for the display housing; and ii. a second pivotable connections, characterized by a second xis of rotation substantially perpendicular to the first axis of the rotation.

* * * * *